United States Patent [19]

Burgess, Jr.

[11] 4,175,481

[45] Nov. 27, 1979

[54] MINE VENTILATION SYSTEM AND ELEMENTS THEREOF

[75] Inventor: James V. Burgess, Jr., Madison, W. Va.

[73] Assignee: Mine Ventilation Systems, Inc., Madison, W. Va.

[21] Appl. No.: 812,719

[22] Filed: Jul. 5, 1977

[51] Int. Cl.[2] ..... E21F 1/14

[52] U.S. Cl. ..... 98/50; 160/330; 299/12; 405/288

[58] Field of Search ..... 98/50; 61/45 R; 299/12, 299/19; 160/349 R, 330; 405/288, 289

[56] References Cited

U.S. PATENT DOCUMENTS

| | | | |
|---|---|---|---|
| 1,298,550 | 3/1919 | Newell | 160/349 R |
| 1,398,909 | 11/1921 | North | 98/50 |
| 2,173,993 | 9/1939 | Amdur | 160/349 R X |
| 2,301,047 | 11/1942 | Hendley | 2/36 |
| 2,687,170 | 8/1954 | Johnson | 160/349 R |
| 2,687,170 | 8/1954 | Johnson | 160/349 R |
| 2,947,239 | 8/1960 | Burgess | 98/50 |
| 3,118,363 | 1/1964 | Burgess, Jr. | 98/50 |
| 3,382,507 | 5/1968 | Micheau | 160/349 R |
| 3,396,545 | 8/1968 | Lamberton | 61/45 R |
| 3,636,852 | 1/1972 | Burgess, Jr. | 98/50 |
| 4,023,372 | 5/1977 | Presler et al. | 98/50 X |

*Primary Examiner*—William F. O'Dea
*Assistant Examiner*—Harold Joyce
*Attorney, Agent, or Firm*—Wilson, Fraser, Barker & Clemens

[57] ABSTRACT

This invention relates to a ventilation system and more particularly to means for restraining a ventilation control curtain composed of a post like members formed of an elongate containers of flexible material filled with material such as mine debris which give them a degree of rigidity and mass. The post like constraining members check the horizontal displacement of the mine curtain thereby forming a stable curtain structure which may be used as an efficient gas flow director within the mine or to isolate a desired area of the mine to contain mine gas or airborn particulates. They are sufficiently yieldable to offer no collision hazzard to personnel or machinery. The envelopes forming curtain constraints are disclosed as individual elements and as integral pockets on the face of the curtain.

7 Claims, 6 Drawing Figures

MINE VENTILATION SYSTEM AND ELEMENTS THEREOF

BACKGROUND OF THE INVENTION

1. Field of the Invention

This invention relates to mine ventilation controls and more particularly to means for constraining mine ventilation sheeting material within a mine to a desired placement for directing the flow of ventilating air.

2. Description of the Prior Art

Previously, some movable ventilation systems have used rigid poles or posts to restrain the mine curtain. In Burgess U.S. Pat. No. 3,118,363, for example, rigid, adjustable length metal posts provided the restraint means for the curtain. Other systems have employed flexible battens as semi-rigid restraining means for the curtain. In Burgess U.S. Pat. No. 3,636,852 semi-rigid plank-like members supplied the necessary restraint means.

While both of the above types of restraint members are effective for the intended use both require two opposing mine surfaces for their attachment and neither are collapsable enough to facilitate ease in ingress and egress to the mine. Also, such rigid constraining members have caused serious injuries by being placed on the blind side of a mine curtain, as is commonly known in the mining trades.

In accordance with the above, an objective of the invention is to direct gas flow within a mine.

A second object is to provide an economical constraining means for mine curtains employed in directing gas flow in the mine. Such economic considerations include original cost, errection and dismantling expense, transportation expense and storage expense.

A third object is to facilitate the handling of the constraining means for mine ventilation curtains.

Another object is to eliminate or minimize the possibility of injury from contact by personnel or machinery with mine ventilation curtains which are backed up by curtain constraints.

A still further object of the invention is to provide a system which is rapidly moveable within the mine to keep pace with the mining process as well as to be deployable in close quarters by virtue of its flexibility, a feature lacking in rigid or semi-rigid restraining systems.

SUMMARY OF THE INVENTION

The above objectives are achieved in the present invention by means of a pocket or envelope of flexible sheet material advantageously in the general form and size of a curtain restraining post and filled with material which give it sufficient body and mass to restrain a curtain. A mine ventilation control system composed of a barrier for the segregation of gas flow within a mine employing a flexible substantially gas impervious sheet material attachable to one or more mine surfaces is maintained in a floor to ceiling orientation by positioning filled envelopes adjacent the curtain. In one embodiment a flexible body in the form of an envelope of sheet material which when filled with a fluid or particulate mass, typically mine debris, rocks, water, or the like, and of the general form and extent of a mine post is suspended against a gas directing curtain on the low gas pressure side thereof to constrain the curtain against displacement. The system includes means for maintaining the constraining means and the mass therein proximate to and extending vertically along the sheet material as by suspending them from the mine ceiling on the low pressure side of the curtain. Alternatively, the envelopes can be secured to the curtain across it's face.

In use, the flame-resistant, flexible sheet material in envelopes form suitable for posts are stored and transported to the work site in compact folded or rolled condition. They are filled on site with appropriate material to add mass then deploying the post adjacent to the sheet material. In practice the constraining posts are suspended or otherwise mounted opposite the surface of the sheet material upon which the force is exerted tending to displace horizontally that material.

Since the constraint posts may be filled to any desired length with debris or other material, the system is adjustably deployable in areas having low ceilings where as other commonly used constraint posts are not so adjustable.

BRIEF DESCRIPTION OF THE DRAWINGS

The principles and advantages of the invention are set forth in the following detailed description of the invention accompanied by the drawings herein, in which.

DESCRIPTION OF THE PREFERRED EMBODIMENT

Figure 1:
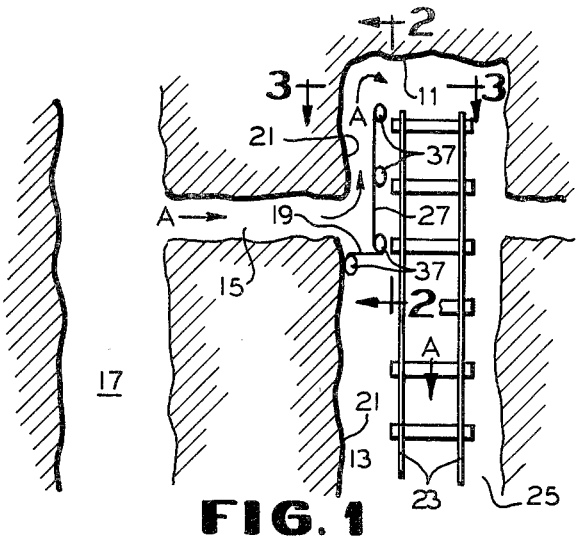
FIG. 1 is a diagrammatic plan view of an underground mine showing one method of using the invention to establish a desired air flow path through a given mine region.
Figure 2:
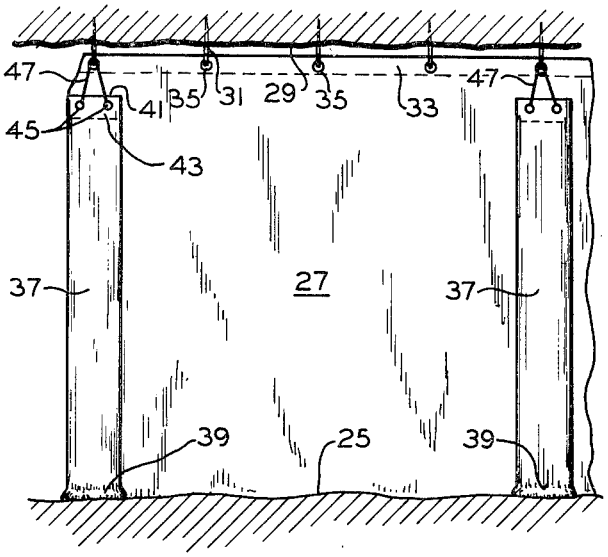
FIG. 2 is a fragmentary section post elevational view of one form of this invention as viewed along the line 2—2 of FIG. 1.
Figure 3:
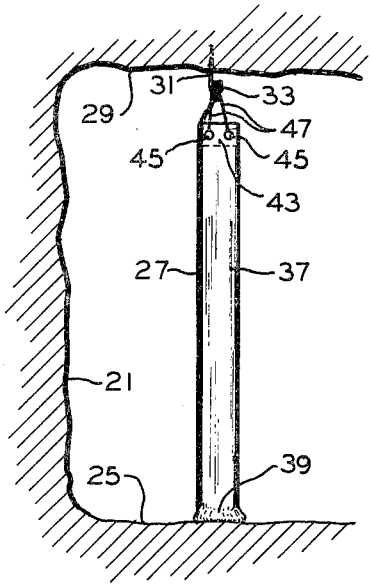
FIG. 3 is a fragmentary sectioned end elevational view of the invention of FIGS. 1 and 2 as viewed along the line 3—3 of FIG. 1.

FIG. 1 illustrates a typical mine having a working face 11 at the end of a corridor 13 and a cross corridor 15 from an adjacent corridor 17 through which ventilating air is passed as shown by the arrows A. A section of line curtain 19 extends from a side wall 21 to a position adjacent track 23 of the mine floor 25 and a further section 27 of the line curtain extends generally parallel to the side wall 21 and track 23 toward and in proximity to working face 11. Line curtain sections 19 and 27 extend between the ceiling 29 and floor 25 as best seen in FIGS. 2 and 3. They form one side of a ventilating duct to the working face, the mine side wall 21 forming an opposite side of the duct and the floor 25 and ceiling 29 forming the duct bottom and top respectively.

Arrows A represent an inflow of air to the working face such that a greater air pressure is imposed on the faces of line curtain sections 19 and 27 which are proximate the cross corridor 15 from which the air is supplied than that pressure imposed on the faces remote from corridor 15. Such a pressure differential tends to cause displacement of the curtain outward of the duct.

Curtain sections 19 and 27 are suspended from the mine ceiling 29 by any convenient means. Typically, suspension hooks 31 are anchored in the ceiling, the curtain is reinforced along its upper margin 33 and grommets 35 are provided through the reinforced portion 33 to accommodate the suspension hooks. The air pressure differential thus tends to displace that portion of the curtain beneath the suspension means outward of the vertical plane beneath the curtain suspension means where the assumed higher pressure is within the duct. Conversely, if the duct pressure were lower than that in the major portion of the corridor, the suspended curtain would tend to balloon inward of the duct.

Curtain constraining means 37 in the form of post like bodies of substantial mass are positioned adjacent the curtain sections 19 and 27 to inhibit or eliminate ballooning. These constraining means 37 are envelopes of flame-resistant, flexible sheet material in elongate tubular form adapted to be filled with material available at the site and to be suspended adjacent the line curtain. The envelopes are closed at their bottom ends 39 to retain the material with which they are filled, typically mine debris, sufficiently finely divided to have some fluid characteristics and to permit the envelope walls to yield to a limited degree. Water might also be employed as the filler. Suspension of envelopes 37 is from their upper ends 41 which are provided with a reinforced perimeter 43 and attaching means such as grommets 45 from which line cable, chain, or wire suspension loops 47 extend to suitable supports. The curtain support hooks 31 are one such support to be engaged by the loop 47 secured to the attaching means 45. The upper end 41 of the envelopes 37 can be open to facilitate filling them with the material which lends mass and stiffness for constraining the line curtain.

The semi-fluid or yieldable mine posts provided by the filled envelopes 37 offer a number of advantages. When empty, they are light weight and readily folded or rolled into compact form for convenient storage and transportation. Installation of the yieldable mine post constraining means is also quite simple since they can be placed either empty, partially filled or completely filled. The empty or partially filled envelopes can be filled in place as when suspended from a ceiling hook 31. In any event, the filling need be done only at the site of use in the immediate vicinity of use. Movement or removal of the constraining means involves emptying the envelope of the filler material such that only the relatively light weight envelope need be moved. While the constraining means is effective when it is short of the mine floor and is biased to a vertical orientation solely by gravity, it is advantageous to add the frictional engagement of the lower end 39 with the mine floor 25 as a limit on displacement at the lower end. In this regard, the envelope tube of the constraining means 37 can exceed the distance from the upper end 41 to the floor 25 and thus accomodate a wide range of floor-to-ceiling heights since the lower end can fold over at the floor and/or partially collapse upon itself to take up the excess length.

In the embodiments of FIGS. 1, 2 and 3, the constraining means 37 are shown as tubes independent of the mine curtain sections 19 and 27. In such arrangements, the means 37 are located on the low pressure side of the curtain so that the air pressure differential operates to force the curtain against the means 37 and they constrain ballooning of the curtain by lying against its face. An alternative approach is to secure the constraining means 37 to the curtain 27 across its face. In such an arrangement, the constraining means is effective whether on the low pressure or high pressure side of the curtain.

Figure 4:
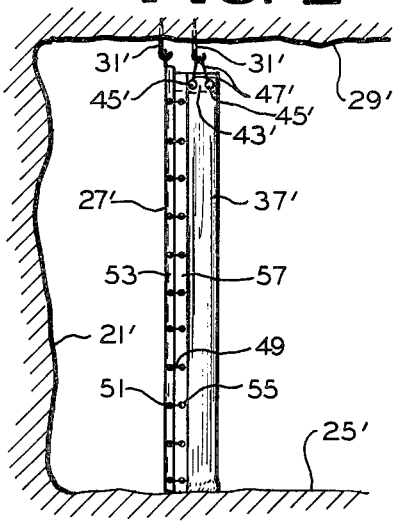
FIG. 4 is a view similar to FIG. 3 of another form of this invention.

FIG. 4 shows a constraining means 37' which is separable from curtain 27' and is secured thereto as by binding line 49. In this arrangement a series of fasteners 51 are secured to the curtain 27', for example, as grommets through a tab strip 53 sewn or otherwise secured to the face of the curtain. A similar arrangement of fasteners 55 extend along the length of the constraining means 37', for example, as grommets through a tab strip 57 sewn or otherwise secured to the envelope wall. Line 49 engages the fasteners 51 and 55 as a lacing to secure the elements together. Otherwise, the flexible mine post constraining means is mounted and functions as previously described utilizing primed reference characters for elements corresponding to those set forth above.

Figure 5:
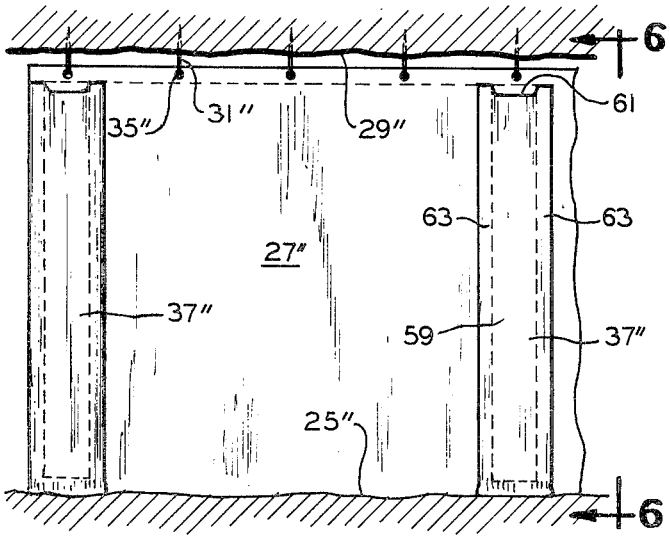
FIG. 5 is a view similar to FIG. 2 of a form of this invention wherein the curtain restrainer is integral with the curtain.
Figure 6:
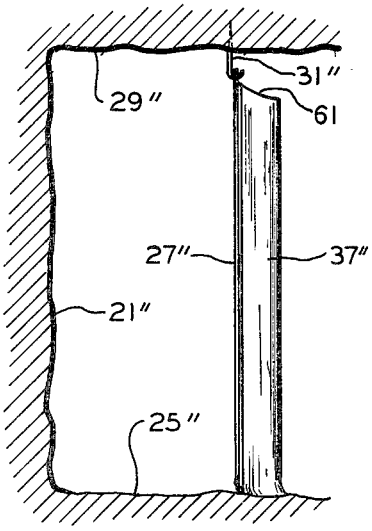
FIG. 6 is a sectional end elevational view of the embodiment of FIG. 5 taken along the line 6—6 of FIG. 5.

In FIGS. 5 and 6 the constraining means 37'' is shown as an integral part of curtain 27''. Panels 59 of sheet material, which can be the same material as the curtain if heavy enough, are sewn to the face of the curtain as pockets extending across its width at spaced intervals. The panels can have an inner panel (not shown) if the curtain material is of insufficient weight to accommodate the debris or other material introduced into the pocket through the top opening 61. A securing band 63 which may be in the form of a double thickness of the material is shown as the panel securing means in this embodiment. Double primed reference characters are employed in this embodiment to illustrate and identify elements corresponding to those previously discussed.

It is to be understood that the invention can be practiced in various forms and with various materials and fastening elements without departing from its spirit or scope. For example, while woven sheet material might be employed with suitable flame-retardency, sheet materials of non woven form which are acceptable are vinyl chloride-vinglidene chloride copolymers and the like, or those materials containing fire-retardant compounds like tricresyl phosphate or chlorinated compounds. Any of the materials should meet the flame spread index test of less than 25 under ASTM E162 Tests for mine safety. The grommet fasteners shown can be in part or wholy supplanted by hooks or other fasteners. In view of the above, the present disclosure is to be read as the best mode contemplated for the invention and not in a limiting sense.

I claim:

1. A mine ventilation control system providing a barrier for the segregation of gas flow between at least two regions of a mine cavity; said system comprising:

a flexible substantially gas impervious sheet material extending between said regions to impede gas flow therebetween;

means for securing marginal edge portions of said sheet material to an adjacent mine surface;

an elongate envelope of flexible sheet material for containing a fluid mass;

a fluid mass in said envelope; and means to maintain said fluid filled envelop proximate to and extending generally vertically along said sheet material whereby said mass and the stiffness of said filled envelope militate against ballooning of said sheet material.

2. The invention defined in claim 1 wherein said envelope is an elongated, hollow, tubular structure of flame retardant material oriented with its longitudinal axis generally vertical and closed at its lower end.

3. The invention defined in claim 2 wherein said mine cavity has a floor and at least one end portion of said envelope is in frictional contact with the floor of said mine cavity.

4. The invention defined in claim 1 wherein said fluid material is particulate solid material.

5. The invention defined in claim 1 wherein said mine cavity has a roof and said means for securing marginal edge portions of said sheet material is secured to the mine roof and is pendant therefrom.

6. The invention defined in claim 1 wherein said envelope is secured to the surface of said sheet material.

7. The invention defined in claim 1 wherein said envelope is integral with said sheet material.

* * * * *